US012522408B1

(12) United States Patent
Lu

(10) Patent No.: US 12,522,408 B1
(45) Date of Patent: Jan. 13, 2026

(54) CUP LID WITH STRAW

(71) Applicant: Guosheng Lu, Fuzhou (CN)

(72) Inventor: Guosheng Lu, Fuzhou (CN)

( * ) Notice: Subject to any disclaimer, the term of this patent is extended or adjusted under 35 U.S.C. 154(b) by 0 days.

(21) Appl. No.: 19/270,392

(22) Filed: Jul. 15, 2025

(51) Int. Cl.

| | |
|---|---|
| ***B65D 47/28*** | (2006.01) |
| ***A47G 19/22*** | (2006.01) |
| ***B65D 47/06*** | (2006.01) |
| ***B65D 47/32*** | (2006.01) |

(52) U.S. Cl.
CPC ..... *B65D 47/286* (2013.01); *B65D 47/06* (2013.01); *B65D 47/32* (2013.01); *A47G 19/2272* (2013.01); *B65D 2205/02* (2013.01); *B65D 2251/20* (2013.01); *B65D 2547/066* (2013.01)

(58) Field of Classification Search
CPC ..... B65D 47/286; B65D 47/06; B65D 47/32; B65D 2205/02; B65D 2251/20; B65D 2547/066; A47G 19/2272
See application file for complete search history.

(56) References Cited

U.S. PATENT DOCUMENTS

| | | | | |
|---|---|---|---|---|
| 2,127,911 | A * | 8/1938 | Goss | B65D 47/286 222/561 |
| 2,969,167 | A * | 1/1961 | Libit | B65D 47/286 222/545 |
| 5,058,778 | A * | 10/1991 | Weinstein | B65D 83/00 222/548 |
| 5,238,061 | A * | 8/1993 | Strihafka | E21B 4/02 166/170 |
| 5,996,857 | A * | 12/1999 | Markos | B65D 47/268 222/560 |
| 6,279,773 | B1 | 8/2001 | Kiyota | |
| 9,238,529 | B1 * | 1/2016 | Newman | B65D 47/32 |
| 10,486,868 | B2 | 11/2019 | Spivey et al. | |
| 11,825,966 | B2 | 11/2023 | Lin | |
| 2023/0029205 | A1 * | 1/2023 | Omdahl, II | A47G 19/2222 |

FOREIGN PATENT DOCUMENTS

| | | | | |
|---|---|---|---|---|
| WO | WO-2007077432 A2 * | 7/2007 | | B65D 47/286 |

* cited by examiner

*Primary Examiner* — James N Smalley

(57) ABSTRACT

A cup lid includes a cup lid body and a slider. A second channel and a water outlet sealing block are arranged in the slider, enabling control over the opening and closing of a first channel for a liquid through sliding. The water outlet sealing block is provided with a sealing portion and a water outlet hole portion, enabling a switching between sealing and conducting. The cup lid body is further provided with an air vent, and the bottom of the slider is provided with an air outlet sealing block, which synchronously control a first channel for air.

8 Claims, 10 Drawing Sheets

CUP LID WITH STRAW

BACKGROUND

1. Technical Field

The embodiments of the present disclosure relate to the technical field of drinking utensils, and in particular, to a structure of a cup lid with a straw.

2. Background Information

Currently, C a cup lid with a straw commonly available on the market typically employs a push switch or rotary switch to control the flow of a liquid. Most of the products only offer a basic water output function, and lack an effective control over air or liquid channels, resulting in unsatisfactory water pouring or obvious negative pressure effect.

BRIEF SUMMARY

The embodiments of the present disclosure provide a cup lid with a straw, which achieves a synchronous control over a water outlet and an air vent by disposing a slidably connected slider structure in conjunction with a water outlet sealing block and an air outlet sealing block, thereby improving the sealing performance and operation convenience for the product.

A first aspect of the embodiments of the present disclosure provides a cup lid with a straw, including: a cup lid body, configured to cover a cup mouth of a cup body and provided with a first channel which communicates with the interior of the cup body and has an upper channel opening; and a slider, slidably mounted on the cup lid body and provided with a second channel, where the second channel has a lower channel opening, the first channel, the second channel and the drinking straw are in communication when the slider slides to a first position along with a drinking straw, and the slider is able to cover the upper channel opening of the first channel to prevent a fluid from flowing out through the upper channel opening when the slider slides to a second position along with the drinking straw.

In some implementations, the cup lid with a straw further includes a water outlet sealing block connected with the slider and synchronously moving with the slider. The water outlet sealing block has a sealing portion and a water outlet hole portion, and the water outlet hole portion is aligned with the lower channel opening of the second channel in a vertical direction. The upper channel opening of the first channel, the water outlet hole portion, and the lower channel opening of the second channel are in communication to form a fluid flow path when the slider slides to the first position, and the sealing portion of the water outlet sealing block seals the upper channel opening of the first channel when the slider slides to the second position, blocking the communication between the upper channel opening of the first channel and the lower channel opening of the second channel, and preventing the fluid from flowing out through the upper channel opening.

In some implementations, the cup lid body is further provided with an air vent configured to be in communication with the interior of the cup body. The cup lid with a straw further includes an air outlet sealing block connected with the slider and synchronously moving with the slider. The air outlet sealing block seals the air vent to prevent the fluid from flowing out through the air vent when the slider slides to the second position.

In some implementations, the cup lid body further includes a drinking straw detachably connected with the second channel. A continuous fluid flow path is formed between the drinking straw and the second channel when both are connected.

In some implementations, the drinking straw is connected to the second channel in an inserting manner.

In some implementations, a sinking groove is recessed in a direction from an upper surface of the cup lid body towards the interior of the cup body, and both the upper channel opening of the first channel and the air vent are disposed on a bottom surface of the sinking groove. The slider is configured to selectively slide in the sinking groove.

In some implementations, a first inner side wall of the sinking groove is provided with a first slideway, and a second inner side wall of the sinking groove is provided with a second slideway. A first outer wall of the slider is provided with a first clamping block, a second outer wall of the slider is provided with a second clamping block, and the slider is slidably connected with the cup lid body through sliding fit between the first clamping block and the first slideway and sliding fit between the second clamping block and the second slideway.

In some implementations, the cup lid body has a lower port extension portion for connecting to the cup mouth, and the lower port extension portion has an external thread connected with an internal thread of the cup mouth.

In some implementations, the drinking straw is in the shape of a truncated cone with a narrow top and a wide bottom, a first end of the drinking straw is a sipping end, and a second end of the drinking straw is inserted into an outer tube wall of the second channel with an interference fit.

In some implementations, a first receiving groove is formed in the bottom of the slider, and the water outlet sealing block is mounted in the first receiving groove.

In some implementations, a second receiving groove is formed in the bottom of the slider, and the air outlet sealing block is mounted in the second receiving groove.

It can be seen from analysis that, the present disclosure discloses a cup lid with a straw. The detachable design of the drinking straw allows for easy cleaning and replacement. The overall structure is compact, easy to operate, and suitable for one-handed use. Excellent sealing performance avoids liquid leakage due to vibration or tilting. The modular design with multiple components facilitates assembly and maintenance.

BRIEF DESCRIPTION OF THE DRAWINGS

The accompanying drawings of the specification, which constitute a part of the present disclosure, are used to provide a further understanding of the present disclosure. The schematic embodiments of the present disclosure and their illustrations are used to explain the present disclosure, and do not constitute inappropriate limitations on the present disclosure. In the drawings.

Figure 1:
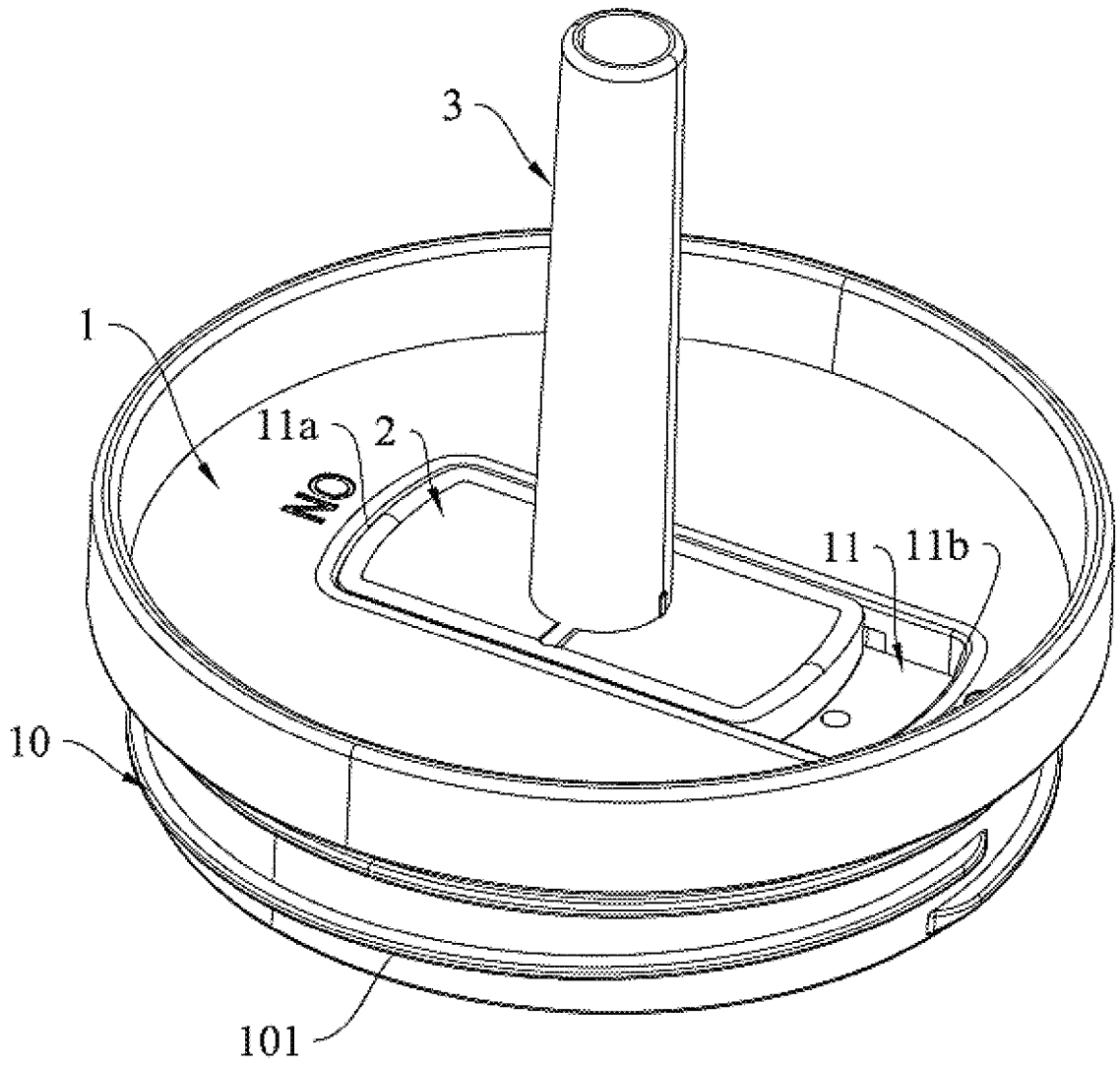
FIG. 1 is a perspective view of a cup lid with a straw in a first state according to some embodiments of the present disclosure.
Figure 2:
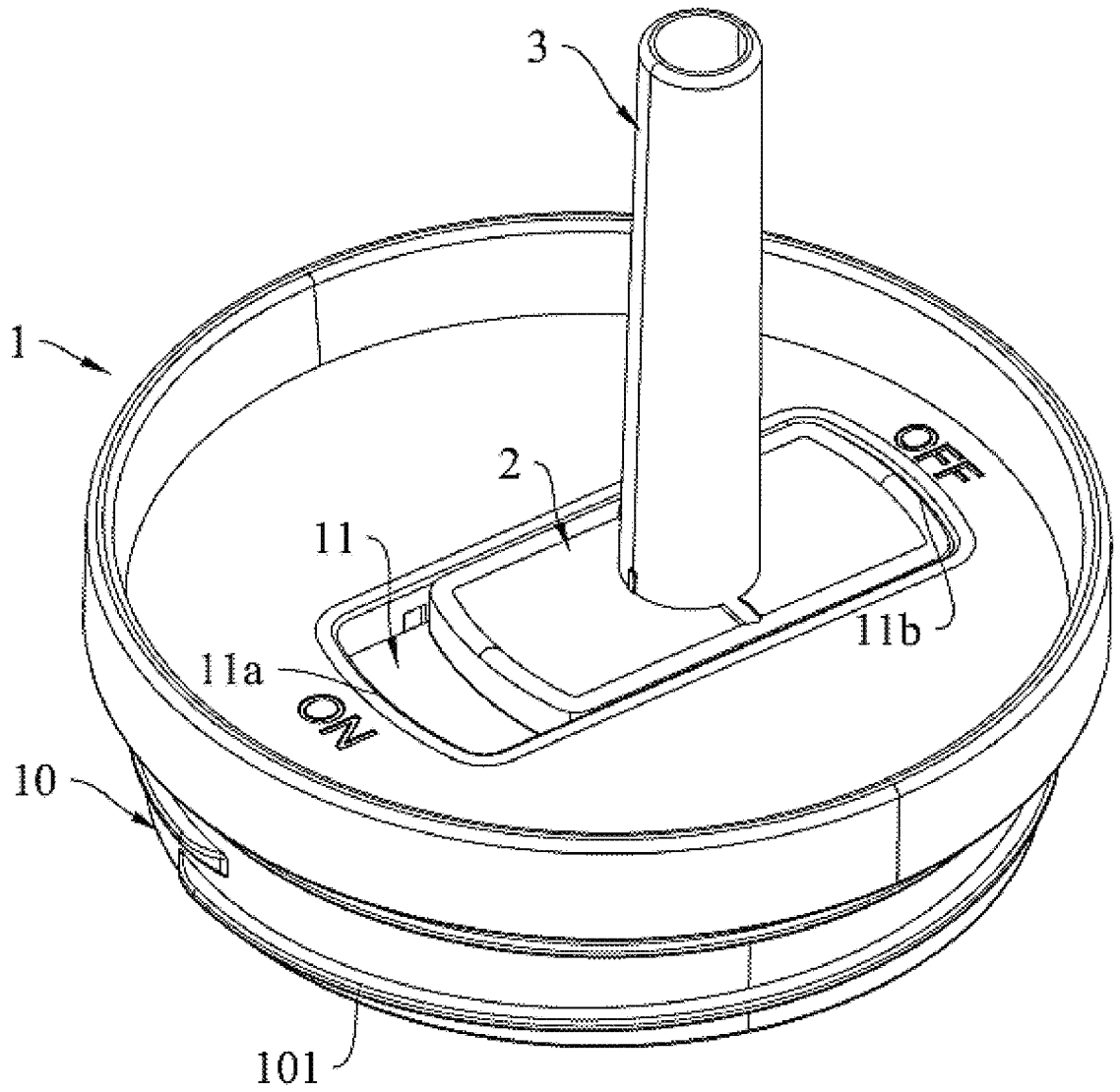
FIG. 2 is a perspective view of the cup lid with a straw in a second state according to some embodiments of the present disclosure.
Figure 3:
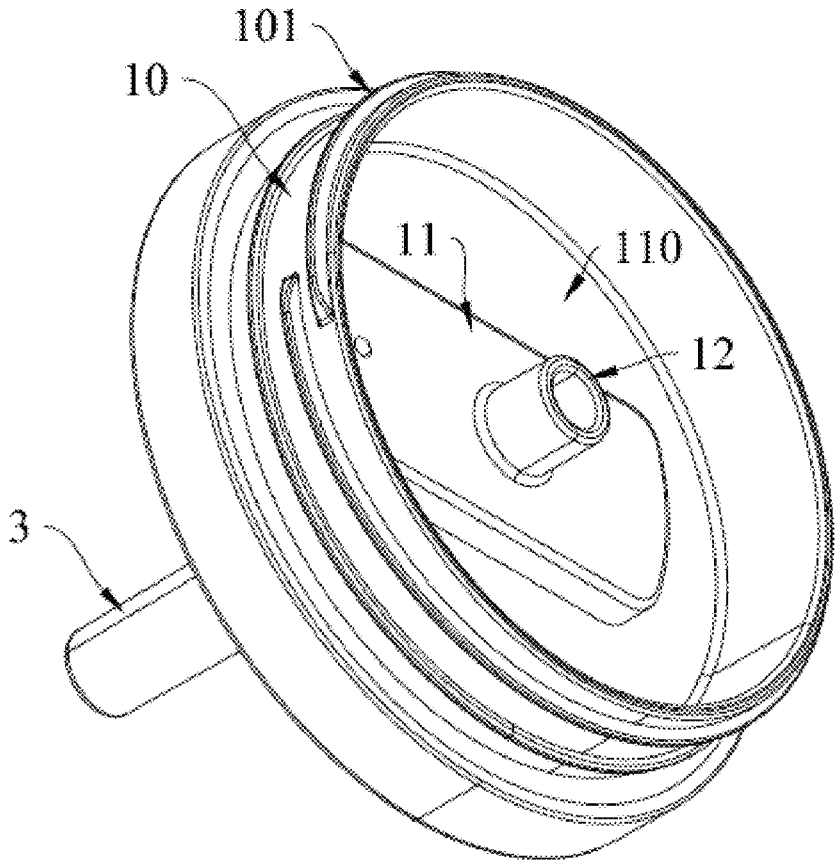
FIG. 3 is a perspective view of the cup lid with a straw at another angle according to some embodiments of the present disclosure.

Reference Numerals: 1—Cup Lid Body; 1*a*—First Inner Side Wall; 1*b*—Second Inner Side Wall; 10—Lower Port Extension Portion; 101—External Thread; 11—Sinking Groove; 11*a*—First Position; 11*b*—Second Position; 12—First Channel; 121—Upper Channel Opening; 13—Air Vent; 111—First Slideway; 112—Second Slideway; 110—First Side; 120—Second Side.

2—Slider; 2*a*—First Outer Wall; 2*b*—Second Outer Wall; 21—First Clamping Block; 22—Second Clamping Block; 23—Second Channel; 231—Lower Channel Opening; 232—Outer Tube Wall; 24—First Receiving groove; 25—Second Receiving groove.

3—Drinking Straw; 3*a*—First End; 3*b*—Second End.

4—Water Outlet Sealing Block; 41—Sealing Portion; 41*a*—First Annular Protrusion; 42—Water Outlet Hole Portion; 42*a*—Second Annular Protrusion.

5—Air Outlet Sealing Block.

DETAILED DESCRIPTION OF THE DRAWINGS AND THE PRESENTLY PREFERRED EMBODIMENTS

The present disclosure will be illustrated below in detail with reference to the accompanying drawings and in conjunction with the embodiments. Various examples are provided by way of explanation of the present disclosure, rather than limiting the present disclosure. Indeed, it will be clear to those skilled in the art that modifications and variations can be made in the present disclosure without departing from the scope or spirit of the present disclosure. For example, features shown or described as part of one embodiment may be used in another embodiment to yield yet another embodiment. Therefore, it is intended that the present disclosure embraces such modifications and variations as come within the scope of the appended claims and their equivalents.

In the description of the present disclosure, terms such as "longitudinal," "transverse," "upper," "lower," "front," "rear," "left," "right," "vertical," "horizontal," "top" and "bottom" indicate orientation or position relationships that are based on those shown in the accompanying drawings, and are only for convenience of describing the present disclosure, rather than requiring the present disclosure to have to be constructed and operated in a particular manner, and thus cannot be understood as limiting the present disclosure. Terms such as "connected," "connection" and "disposed" used in the present disclosure should be broadly understood. For example, it may refer to a fixed connection, a detachable connection, a direct connection or an indirect connection through an intermediate part, a wired electrical connection or a wireless electrical connection, or a wireless communication signal connection. For those ordinary skilled in the art, the specific meanings of the above terms can be understood according to the context.

One or more examples of the present disclosure are shown in the accompanying drawings. The detailed description uses numeric and alphabetic symbols to refer to features in the accompanying drawings. Similar or analogue symbols in the accompanying drawings and the description have been used to refer to similar or analogue parts of the present disclosure. As used herein, terms such as "first," "second" and "third" are used interchangeably to distinguish one component from another, and are not intended to indicate the position or importance of individual components.

As shown in FIGS. 1-10, according to the embodiments of the present disclosure, a cup lid with a straw is provided, including a cup lid body 1 and a slider 2 slidably connected with the cup lid body 1. The cup lid body 1 is configured to cover a cup mouth of a cup body. The cup lid body 1 is provided with a first channel 12 from a first side 110 facing the cup mouth to a second side 120 distal from the cup mouth, and the first channel 12 communicates with the cup body. The first channel 12 has an upper channel opening 121 at the second side 120 distal from the cup mouth. By disposing the first channel 12 which extends into the cup body, the fluid in the cup body can smoothly flow into the internal structure of the cup lid with a straw. The upper channel opening 121 serves as a liquid outlet of the cup lid body 1, ensuring the stability and continuity for a liquid flow path. Meanwhile, this structure is helpful to improve the overall sealing performance and prevent liquid leakage when the cup is not in use. The slider 2 functions as a core control component, enabling switching between opening and closing of the first channel for liquid through sliding. The slider 2 includes a second channel 23 and its lower channel opening 231, forming a key channel for the liquid to flow from the cup lid body 1 to a drinking straw 3. The structural design of the slider 2 ensures smooth liquid flow and excellent guidance.

In some embodiments, as shown in FIGS. 4-10, a water outlet sealing block 4 is embedded in a first receiving groove 24 in the bottom of the slider 2, which not only saves the space, but also makes the overall structure more compact. Meanwhile, the water outlet sealing block 4 is prevented from shifting or falling off during sliding, improving the operational stability. The water outlet sealing block 4 is disposed at one side close to the upper channel opening 121 of the first channel 12, ensuring accurate engagement and disengagement with the upper channel opening 121 of the first channel 12 during the sliding of the slider 2, thereby improving the reliability of the switching action.

The water outlet sealing block 4 slides synchronously with the slider 2, and has a sealing portion 41 and a water outlet hole portion 42, allowing the user to control the opening and closing of the channel for liquid through a simple sliding action.

Figure 6:
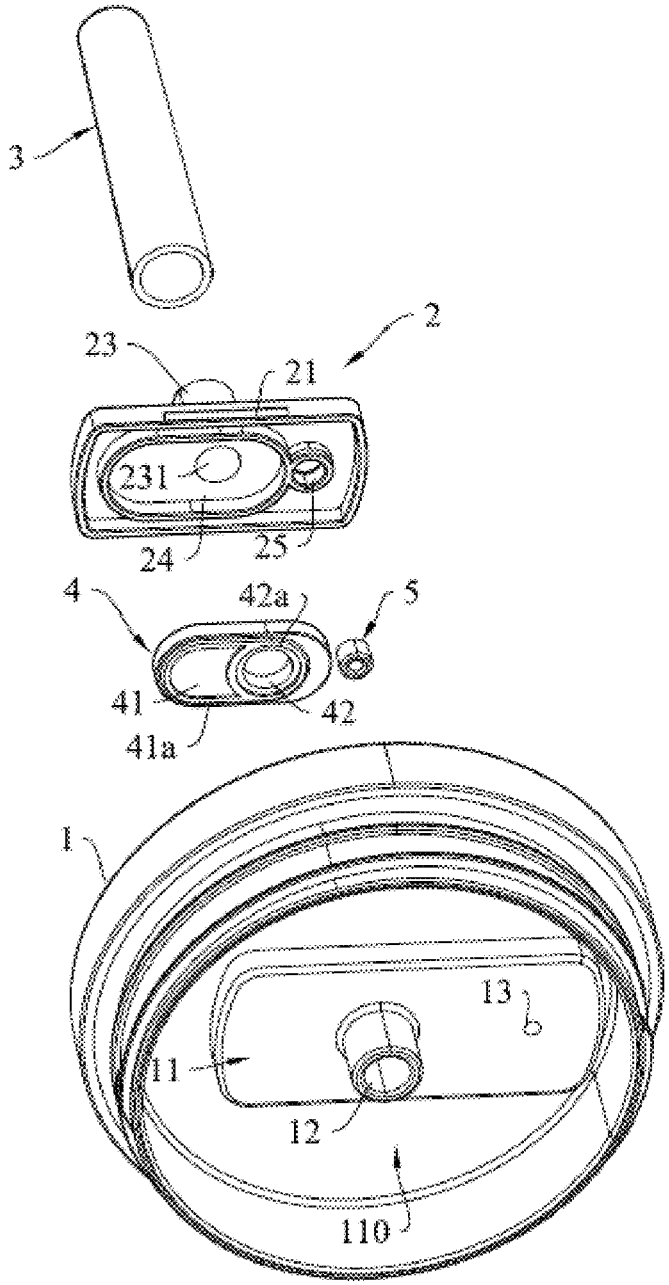
FIG. 6 is an exploded view of the cup lid with a straw at the second angle according to some embodiments of the present disclosure.
Figure 7A:
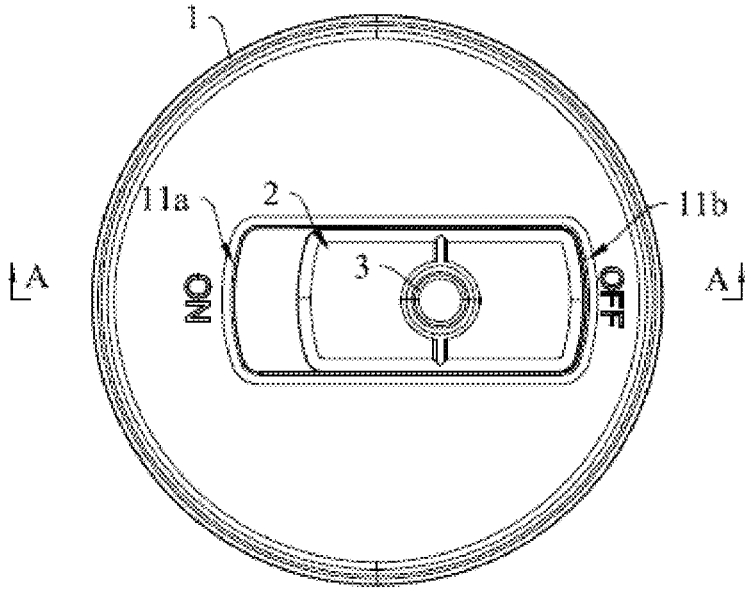
FIG. 7A is a top view of the cup lid with a straw in the second state according to some embodiments of the present disclosure.
Figure 7B:
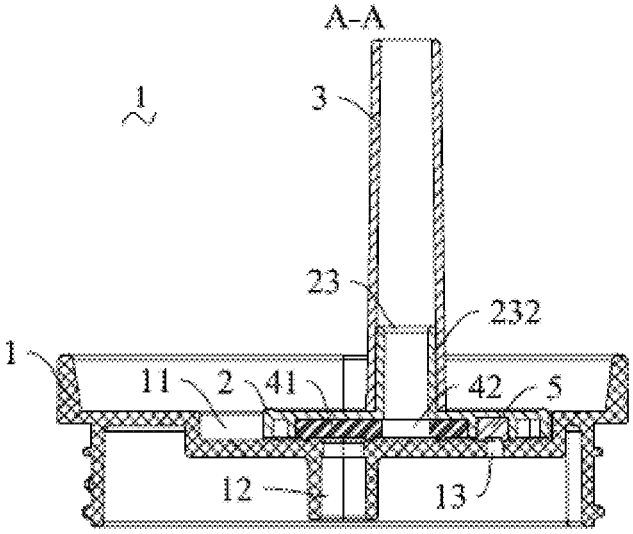
FIG. 7B is a sectional view of FIG. 7A taken in a direction of A-A according to some embodiments of the present disclosure.
Figure 8A:
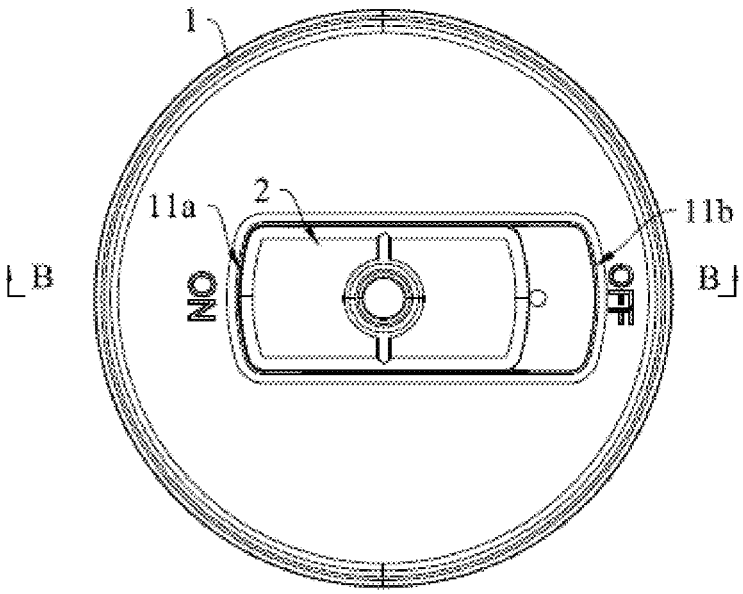
FIG. 8A is a top view of the cup lid with a straw in the first state according to some embodiments of the present disclosure.
Figure 8B:
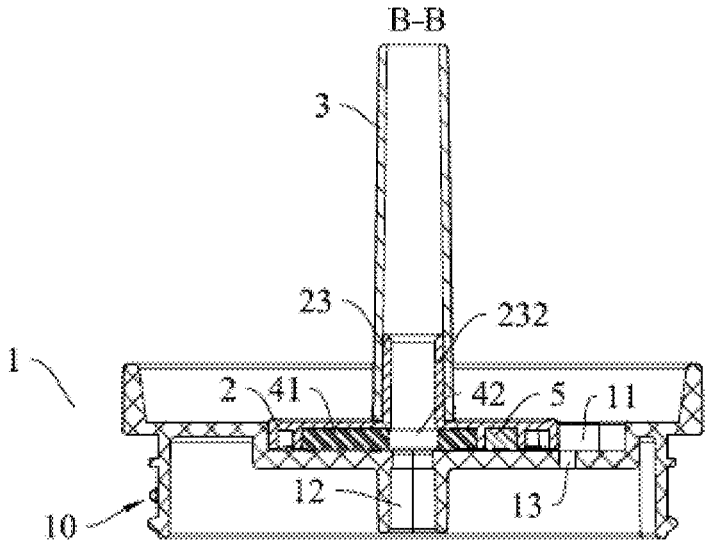
FIG. 8B is a sectional view of FIG. 8A taken in a direction of B-B according to some embodiments of the present disclosure.
Figure 9:
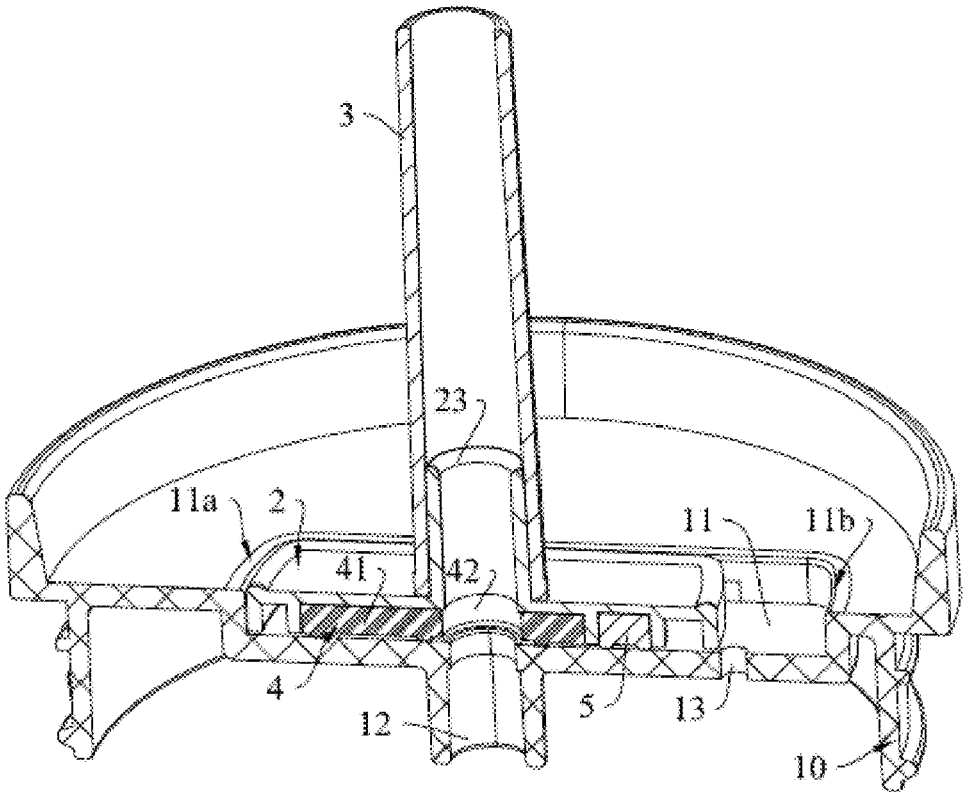
FIG. 9 is a perspective sectional view of the cup lid with a straw communicating in the first state according to some embodiments of the present disclosure.
Figure 10:
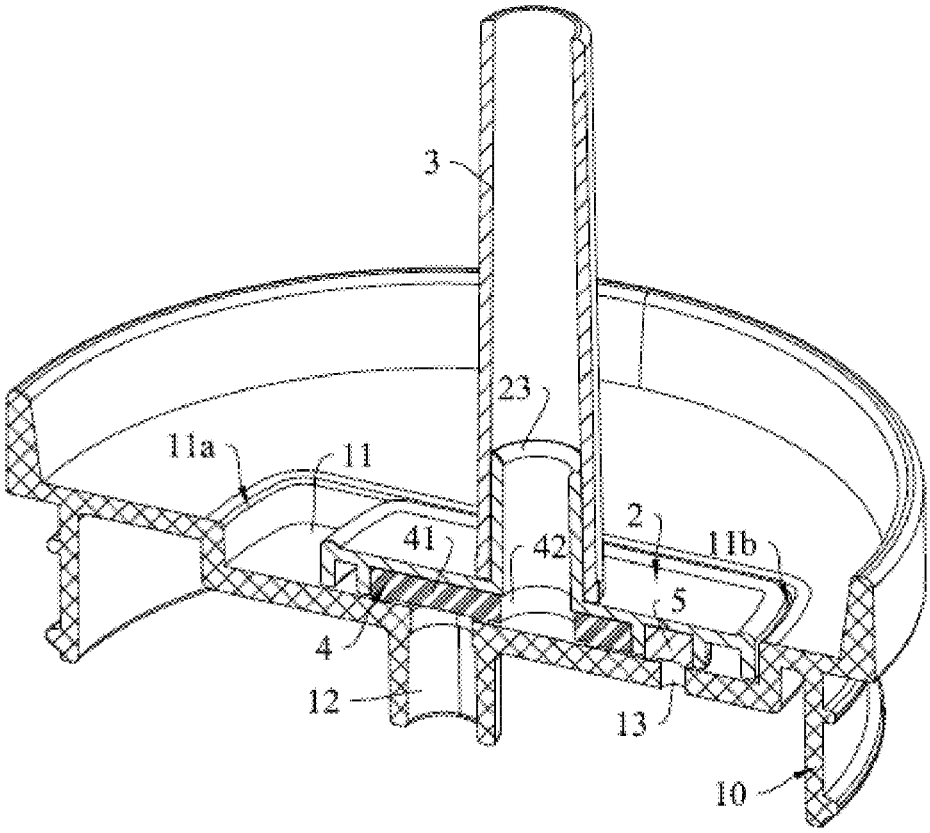
FIG. 10 is a perspective sectional view of the cup lid with a straw communicating in the second state according to some embodiments of the present disclosure.

In some embodiments, as shown in FIG. 6, one side, close to the upper channel opening 121, of each of the sealing portion 41 and the water outlet hole portion 42 is respectively provided with a first annular protrusion 41*a* and a second annular protrusion 42*b* that protrude outward. The first annular protrusion 41*a* and the second annular protrusion 42*b* are configured to enhance the sealing effect, and reduce the frictional force between the water outlet sealing block 4 and a sinking groove 11 by reducing the contact area between the sealing portion 41 and the water outlet hole portion 42, and the bottom of the sinking groove 11. While moving, the first annular protrusion 41*a* and the second annular protrusion 42*b* remain closely fitted to the bottom of the sinking groove 11, ensuring tight contact between the water outlet sealing block 4 and the bottom of the sinking groove 11, thereby preventing water leakage.

The water outlet hole portion 42 is aligned with the lower channel opening 231 of the second channel 23, enabling both to be accurately abutted no matter the slider 2 is at a first position 11*a* or a second position 11*b*. When the slider 2 is at the first position 11*a*, a continuous fluid flow path is formed, ensuring a smooth and unobstructed drinking process. The sealing portion 41 is made of an elastic material, such as food-grade silica gel, which can tightly fit with the channel opening 121 after the slider 2 slides in place, effectively preventing the leakage of a fluid such as liquid or air, thereby improving the safety and portability for the product.

When the slider 2 slides to the first position 11*a*, the upper channel opening 121 of the first channel 12, the water outlet hole portion 42 and the lower channel opening 231 of the second channel 23 are aligned and are in communication. In this case, a complete liquid flow path is formed among the three components, allowing the user to drink normally through the drinking straw. The cup lid is intuitive and convenient to operate, and suitable for one-handed use, especially for scenarios such as driving and exercising.

When the slider 2 slides to the second position 11*b*, the sealing portion 41 of the water outlet sealing block 4 covers the upper channel opening 121 of the first channel 12 for sealing, blocking the communication between the upper channel opening 121 of the first channel 12 and the lower channel opening 231 of the second channel 23, and preventing the fluid such as liquid or air from flowing out through the upper channel opening 121. In this state, all channels for liquid and air are cut off, ensuring no liquid leakage even if the cup is tilted or inverted, thereby greatly improving the sealing performance and usage safety for the product, and making the cup lid suitable for daily carrying and use in different environments.

In some embodiments, as shown in FIGS. 4-6 and FIGS. 9-10, the cup lid body 1 is further provided with an air vent 13 configured to be in communication with the interior of the cup body. The cup lid with a straw further includes an air outlet sealing block 5 embedded in a second receiving groove 25 in the bottom of the slider 2, and close to one side of the air vent 13. The air vent 13 is configured to communicate the air pressures inside and outside the cup body during drinking, preventing poor water flow due to negative pressure. When the slider 2 is at the first position 11*a*, the air vent remains open, ensuring normal drinking. When the slider slides to the second position 11*b*, the air outlet sealing block 5 slides to block off the air vent 13, preventing liquid leakage through the air vent 13.

The air outlet sealing block 5 moves synchronously with the water outlet sealing block 4. When the slider 2 slides to the closing position in the second position 11*b*, both the water outlet channel and the air vent channel are sealed, forming a complete sealing system that effectively prevents liquid leakage from either channel. The sealed air vent 13 and upper channel opening 121 can prevent external pollutants such as dust and bacteria from entering the interior of the cup body, ensuring the cleanliness and drinking safety for the beverage.

Figure 4:
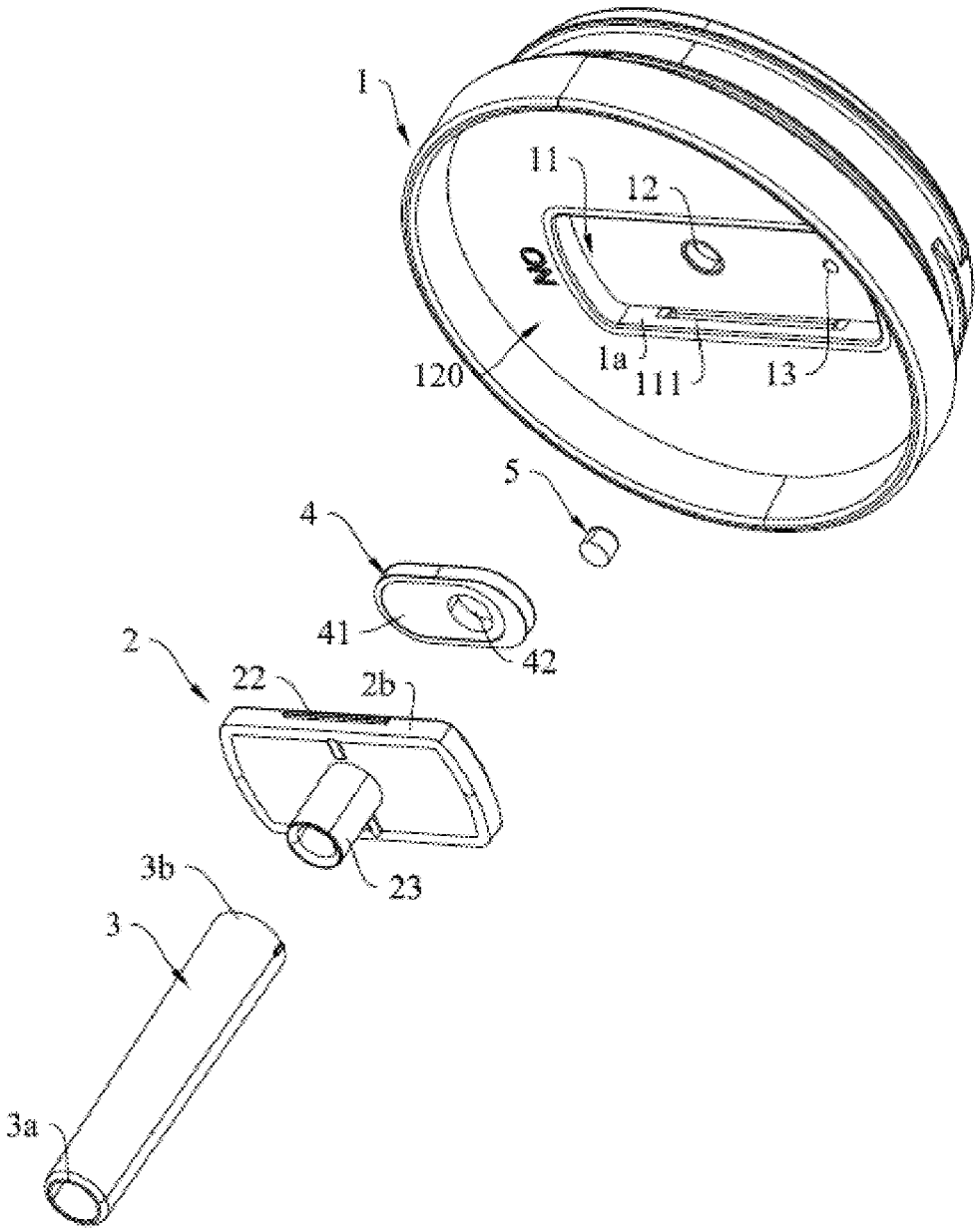
FIG. 4 is an exploded view of the cup lid with a straw at a first angle according to some embodiments of the present disclosure.
Figure 5:
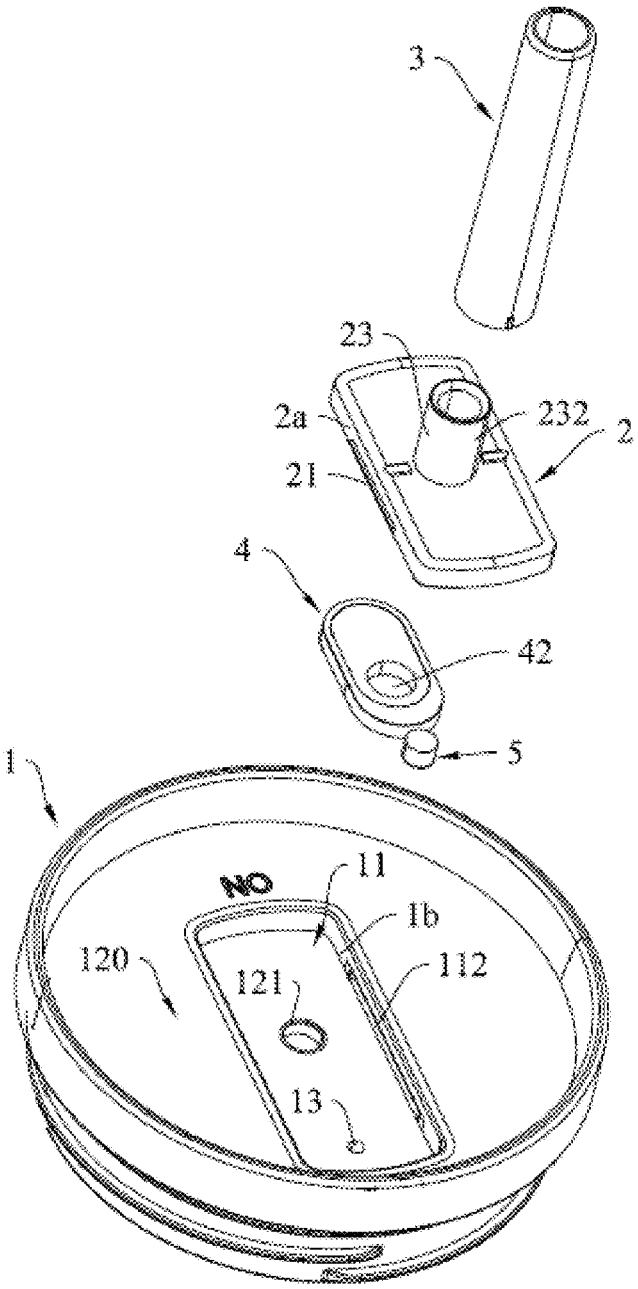
FIG. 5 is an exploded view of the cup lid with a straw at a second angle according to some embodiments of the present disclosure.

In some embodiments, as shown in FIGS. 1-10, the cup lid body 1 further includes a drinking straw 3 detachably connected with the second channel 23 in a inserting manner and synchronously moving with the slider 2. Meanwhile, the user can quickly mount or remove the drinking straw 3 as needed, improving the flexibility and convenience for use. The drinking straw 3 can be replaced independently, allowing the user to choose the drinking straw 3 with different lengths, materials or shapes according to actual requirements, such as a bendy straw for children, and a bite-type straw for sports, thereby improving the applicability for the product. Additionally, the drinking straw 3 can be taken out independently and thoroughly cleaned, effectively preventing dirt accumulation and bacterial growth, thereby improving the sanitary performance for the product. The drinking straw 3 is in the shape of a truncated cone with a narrow top and a wide bottom, which is helpful to guide liquid to the drinking straw smoothly, reduce the flow resistance, and improve the smoothness and comfort while drinking. As shown in FIG. 4, a first end 3*a* of the drinking straw 3 is a sipping end, and a second end 3*b* of the drinking straw 3 is inserted into an outer tube wall 232 of the second channel 23 with an interference fit, by which a tight connection between both is ensured, avoiding problems such as liquid leakage or poor drinking due to looseness. A continuous fluid flow path is formed between the drinking straw 3 and the second channel 23 when both are connected.

In some embodiments, a sinking groove 11 is recessed in a direction from an upper surface of the cup lid body 1 towards the interior of the cup body, and both the upper channel opening 121 of the first channel 12 and the air vent 13 are disposed on the bottom surface of the sinking groove 11. The design of the sinking groove 11 concentrates the upper channel opening 121 of the first channel 12 and the air vent 13 at the bottom of the sinking groove 11, making the overall structure more compact, effectively utilizing the internal space of the cup lid, and avoiding external interference. The slider 2 is configured to selectively slide in the sinking groove 11, and the sinking groove 11 provides excellent limiting and guiding functions, ensuring that the slider 2 moves stably in the sinking groove 11 during movement, without shifting or wobbling. Meanwhile, the sinking groove 11 forms a partially enclosed space, facilitating a tighter fit between the slider 2 and the water outlet sealing block 4 and the air outlet sealing block 5, reducing the risk of liquid leakage, and further improving the overall sealing effect.

In some embodiments, a first inner side wall 1*a* of the sinking groove 11 is provided with a first slideway 111, and a second inner side wall 1*b* of the sinking groove 11 is provided with a second slideway 112. A first outer wall 2*a* of the slider 2 is provided with a first clamping block 21, and a second outer wall 2*b* of the slider 2 is provided with a second clamping block 22. The slider 2 is slidably connected with the cup lid body 1 through sliding fit between the first clamping block 21 and the first slideway 111 and sliding fit between the second clamping block 22 and the second slideway 112. In this case, the slider 2 have excellent guidance and limiting function during moving, ensuring an accurate sliding path and a steady movement. The slider 2 is slidably connected with the cup lid body 1 through sliding fit between the first clamping block 21 and the first slideway 111 and sliding fit between the second clamping block 22 and the second slideway 112. The dual-side slideways in cooperation with the clamping blocks effectively prevent the slider 2 from deviating, jamming or tilting during sliding, improving the operating feel of the user, and making the opening and closing actions smoother and more reliable. The first clamping block 21 and the first slideway 111, and the second clamping block 22 and the second slideway 112 are engaged in an embedded sliding manner, allowing the slider 2 to be mounted and positioned without complicated fasteners, thereby improving the assembly efficiency, and facilitating subsequent disassembly and cleanliness or replacement of parts. The slider 2 can only slide along a predefined path using a slideway limiting structure, preventing accident opening due to an external force, and further improving the safety and portability for the product.

In some embodiments, the cup lid body 1 has a lower port extension portion 10 for connecting to the cup mouth. The lower port extension portion 10 has an external thread 101 connected with an internal thread of the cup mouth. The cup lid body 1 is in cooperation with the cup mouth of the cup body through the lower port extension portion 10 disposed at its lower end, and the cup lid is securely fastened to the cup body by screwing the external thread 101 with the internal thread of the cup mouth, preventing accidental falling off during use. Compared with a snap-fit or inserting connection structure, the threaded connection provides a higher connection tightness, which is helpful to enhance the sealing performance between the cup lid and the cup body, preventing liquid leakage during carrying or use.

In some embodiments, as shown in FIG. 6, a lower end face of the slider 2 is integrally designed as a groove structure. An upper bottom wall of the groove is disposed with one or more annular protrusions, dividing the groove into form a first receiving groove 24 and a second receiving groove 25. Through the above structural design of the annular protrusions, the material usage for the slider 2 can be reduced, thereby reducing the manufacturing cost. Moreover, the contact area between the lower end face of the slider 2 and the bottom of the sinking groove 11 is reduced, reducing the frictional force, which facilitates smoother sliding of the slider 2 on the cup lid body 1. More importantly, the structural design of the grooves and the annular protrusions can further improve the elastic deformation capability of the side walls where the clamping blocks are located on the slider 2, allowing the slider 2 to more easily deform and restore during mounting or removal, thereby improving the assembly convenience and the user experience.

In the present disclosure, the sliding of the slider 2 enables the water outlet sealing block 4 and the air outlet sealing block 5 to synchronously move, controlling the opening and closing of the upper channel opening 121 and the air vent 13, thereby achieving a control over the connection and disconnection of the channel for liquid and the channel for air. In conjunction with multiple innovations such as the design of detachable drinking straw, the structure of sinking groove, and the dual-slideway guiding mechanism, a solution for the cup lid with a straw, which has a compact structure, is easy to operate and convenient to clean and maintain, and has high sealing performance, is realized.

The cup lid body 1 is preferably made of high-strength food-grade polypropylene or tritan copolyester materials, and the drinking straw 3 is made of food-grade silica gel, ensuring that the product is safe and non-toxic during a long-term use, and meets high standard requirements of modern consumers for health and hygiene.

The above are only some of the embodiments of the present disclosure, and are not used to limit the present disclosure. For those skilled in the art, various modifications and variations can be made to the present disclosure. Any modifications, equivalent substitutions, improvements, etc., made within the spirit and principle of the present disclosure shall fall within the protection scope of the present disclosure.

The invention claimed is:

1. A cup lid with a straw, comprising:

a cup lid body configured to cover a cup mouth of a cup body and defined with a first channel, the first channel communicating with an interior of the cup body and having an upper channel opening;

a slider slidably mounted on the cup lid body and defined with a second channel, the second channel having a lower channel opening;

a drinking straw detachably connected with the second channel, a continuous fluid flow path being formed between the drinking straw and the second channel in response to the drinking straw and the second channel being connected, wherein the first channel, the second channel and the drinking straw are in communication in response to the slider sliding to a first position along with the drinking straw;

the slider is configured to cover the upper channel opening of the first channel to prevent a fluid from flowing out through the upper channel opening in response to the slider sliding to a second position along with the drinking straw;

the cup lid body is further defined with an air vent configured to be in communication with the interior of the cup body;

the cup lid further comprises an air outlet sealing block connected with the slider and synchronously moving with the slider;

the air outlet sealing block seals the air vent to prevent the fluid from flowing out through the air vent in response to the slider sliding to the second position;

a sinking groove is indented in a direction from an upper surface of the cup lid body towards the interior of the cup body, and both the upper channel opening of the first channel and the air vent are disposed on a bottom surface of the sinking groove; and the slider is configured to selectively slide in the sinking groove.

2. The cup lid with a straw according to claim 1, further comprising:

a water outlet sealing block connected with the slider and synchronously moving with the slider; wherein the water outlet sealing block comprises a sealing portion and a water outlet hole portion, and the water outlet hole portion is aligned with the lower channel opening of the second channel in a vertical direction;

wherein the upper channel opening of the first channel, the water outlet hole portion, and the lower channel opening of the second channel are in communication to form a fluid flow path in response to the slider sliding to the first position; and in response to the slider sliding to the second position, the sealing portion of the water outlet sealing block seals the upper channel opening of the first channel to block the communication between the upper channel opening of the first channel and the lower channel opening of the second channel and prevent the fluid from flowing out through the upper channel opening.

3. The cup lid with a straw according to claim 1, wherein: the drinking straw is connected to the second channel in an inserting manner.

4. The cup lid with a straw according to claim 1, wherein: a first inner side wall of the sinking groove is provided with a first slideway, and a second inner side wall of the sinking groove is provided with a second slideway; and a first outer wall of the slider is provided with a first clamping block, a second outer wall of the slider is provided with a second clamping block, and sliding fit between the first clamping block and the first slideway and sliding fit between the second clamping block and the second slideway allow the slider to be slidably connected with the cup lid body.

5. The cup lid with a straw according to claim 1, wherein: the cup lid body has a lower port extension portion for connecting to the cup mouth, and the lower port extension portion defines an external thread configured to be connected with an internal thread of the cup mouth.

6. The cup lid with a straw according to claim 1, wherein: the drinking straw is in the shape of a truncated cone with a narrow top and a wide bottom, a first end of the drinking straw is a sipping end, and a second end of the drinking straw is inserted into an outer tube wall of the second channel by an interference fit.

7. The cup lid with a straw according to claim 2, wherein: a first receiving groove is formed in a bottom of the slider, and the water outlet sealing block is mounted in the first receiving groove.

8. The cup lid with straw according to claim 7, wherein: a second receiving groove is formed in the bottom of the slider, and the air outlet sealing block is mounted in the second receiving groove.

* * * * *